US009821943B2

(12) United States Patent
Dalo et al.

(10) Patent No.: US 9,821,943 B2
(45) Date of Patent: Nov. 21, 2017

(54) DETACHABLE FITMENT

(71) Applicant: COLGATE-PALMOLIVE COMPANY, New York, NY (US)

(72) Inventors: Phillip Dalo, Rochester, NY (US); Derek M. Samaroo, Edison, NJ (US); Brian G. Worthington, Dunellen, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/968,580

(22) Filed: Dec. 14, 2015

(65) Prior Publication Data

US 2017/0166378 A1 Jun. 15, 2017

(51) Int. Cl.

| | |
|---|---|
| ***B65D 33/00*** | (2006.01) |
| ***B65D 75/54*** | (2006.01) |
| ***B65D 75/58*** | (2006.01) |
| ***B65D 47/28*** | (2006.01) |

(52) U.S. Cl.

CPC ..... *B65D 75/54* (2013.01); *B65D 47/28* (2013.01); *B65D 47/286* (2013.01); *B65D 75/5811* (2013.01); *B65D 2575/586* (2013.01)

(58) Field of Classification Search

CPC ..... B65D 33/1666; B65D 33/2591; B65D 75/54; B65D 47/28; B65D 47/286; B65D 75/5811; Y10T 24/158; Y10T 24/2561; A44B 19/26; A44B 19/267

USPC .. 383/68–71, 78, 80, 82, 83, 89, 90, 62, 66, 383/67, 200, 202–204, 906; 24/30.5 R, 24/30.5 L; 222/531, 537, 559, 526, 544, 222/92, 566, 567, 105

See application file for complete search history.

(56) References Cited

U.S. PATENT DOCUMENTS

| | | | | | |
|---|---|---|---|---|---|
| 1,578,077 | A * | 3/1926 | Courney | B65D 47/286 | 222/105 |
| 1,785,599 | A * | 12/1930 | Schmerler | B65D 3/268 | 229/125.08 |
| 1,961,382 | A * | 6/1934 | Nunes | B65D 3/20 | 229/125.12 |
| 2,093,978 | A * | 9/1937 | Farmer | B65D 33/30 | 383/200 |
| 2,139,085 | A * | 12/1938 | Lawson | B65D 47/28 | 222/542 |
| 2,620,944 | A * | 12/1952 | Stahl | B65D 75/5822 | 206/525 |
| 3,422,997 | A * | 1/1969 | Anderson | B65D 47/26 | 215/321 |

(Continued)

FOREIGN PATENT DOCUMENTS

| | | | | |
|---|---|---|---|---|
| JP | 2000142733 A * | 5/2000 | | B65D 31/12 |
| WO | WO2005/122828 | 12/2005 | | |
| WO | WO2008/034168 | 3/2008 | | |

*Primary Examiner* — Jes F Pascua

(57) ABSTRACT

A fitment for a sachet includes a body having a slot that extends from a lower surface of the body toward an upper surface of the body. The upper surface caps the slot in a first portion of the body such that fluid flow is prevented through the first portion of the body in a direction from the lower surface toward the upper surface. The slot connects to an opening in the upper surface in a second portion of the body. A flow path exists through the slot and the opening in the second portion of the body in the direction from the lower surface toward the upper surface.

4 Claims, 7 Drawing Sheets

(56) References Cited

U.S. PATENT DOCUMENTS

| | | | | | |
|---|---|---|---|---|---|
| 3,462,027 | A * | 8/1969 | Puckhaber | B60P 7/065 | 206/522 |
| 3,463,380 | A * | 8/1969 | Cooperstein | B65D 5/069 | 229/125.08 |
| 3,693,864 | A * | 9/1972 | Wilkins | B65D 5/069 | 206/807 |
| 4,580,342 | A * | 4/1986 | Beuzart | B67B 7/30 | 222/81 |
| 4,979,668 | A * | 12/1990 | Allen | B65D 5/069 | 229/125.12 |
| 5,507,431 | A * | 4/1996 | Bertone | B65D 5/069 | 229/125.39 |
| 6,293,701 | B1 * | 9/2001 | Tomic | B65D 33/2591 | 24/400 |
| 6,543,644 | B2 * | 4/2003 | Makino | A47G 23/0258 | 206/521 |
| 6,622,891 | B2 * | 9/2003 | Makino | A47G 23/0258 | 222/105 |
| 6,626,327 | B2 * | 9/2003 | Makino | A47G 23/0258 | 222/105 |
| 6,935,781 | B2 * | 8/2005 | Makino | A47G 23/0258 | 383/16 |
| 8,276,793 | B2 | 10/2012 | Dicks et al. | | |
| 2005/0220372 | A1 * | 10/2005 | Withers | B65D 33/2591 | 383/64 |

* cited by examiner

DETACHABLE FITMENT

BACKGROUND

A sachet is a disposable package that is used to store a consumer product. A sachet typically includes a front panel and a back panel that are coupled together around the edges. To access the product, a user tears a portion of the front panel and/or the back panels, usually along a dotted line that says "tear here," to create an opening. The user may then squeeze the sachet to cause the consumer product to flow out through the opening. One common example of a sachet is a ketchup packet at a fast food restaurant.

Oftentimes, the user may not use all of the consumer product in the sachet. However, there is currently no convenient way to reseal the sachet after it has been opened. As a result, the user typically discards the partially-used sachet rather than saving it for use at a later time. What is desirable is an improvement for resealing a sachet after it has been opened.

BRIEF SUMMARY

A fitment for a sachet is disclosed. The fitment may include a body having a slot that extends from a lower surface of the body toward an upper surface of the body. The upper surface caps the slot in a first portion of the body such that fluid flow is prevented through the first portion of the body in a direction from the lower surface toward the upper surface. The slot connects to an opening in the upper surface in a second portion of the body. A flow path exists through the slot and the opening in the second portion of the body in the direction from the lower surface toward the upper surface.

Optionally, the first portion of the body and the second portion of the body are integral with one another and laterally-adjacent to one another. Optionally, a length of the slot is equal to a length of the body. Optionally, a first recess is defined in the lower surface of the second portion of the body. Optionally, a second recess is defined in the upper surface of the second portion of the body, and the first and second recesses are aligned with one another. Optionally, a width of the slot varies in the first recess, the second recess, or both recesses. Optionally, a first inner surface of the body that defines the slot comprises a first protrusion extending inwardly therefrom. Optionally, the first protrusion is positioned closer to the lower surface of the body than the upper surface of the body. Optionally, a second, opposing inner surface of the body that defines the slot comprises a second protrusion that extends inwardly therefrom and toward the first protrusion. Optionally, a width of the slot tapers proximate to a side surface of the body.

A packaging system is also disclosed. The packaging system includes a sachet having comprising a front panel and a back panel that are coupled to one another. The front panel and the back panel define an interior volume having a consumer product disposed therein. A fitment includes a body having a slot that extends from a lower surface of the body toward an upper surface of the body. The upper surface caps the slot in a first portion of the body such that fluid flow is prevented through the first portion of the body in a direction from the lower surface toward the upper surface. The slot connects to an opening in the upper surface in a second portion of the body. A flow path exists through the slot and the opening in the second portion of the body in the direction from the lower surface toward the upper surface. The sachet is configured to be inserted at least partially into the slot of the fitment.

Optionally, the sachet is configured to be torn by a user to provide an opening in the sachet, and the fitment is configured to seal the opening in the sachet when the sachet is inserted in the slot and the first portion of the body is aligned with the opening in the sachet. Optionally, the fitment is configured to allow the consumer product to flow through the opening in the sachet when the sachet is inserted in the slot and the second portion of the body is aligned with the opening in the sachet. Optionally, the fitment is adhered to the front panel or the back panel of the sachet prior to the sachet being inserted into the slot. Optionally, a first recess is defined in the lower surface of the second portion of the body, a second recess is defined in the upper surface of the second portion of the body, and the first and second recesses are aligned with one another.

In another embodiment, the packaging system includes a sachet having a front panel and a back panel that are coupled to one another. The front panel and the back panel define an interior volume having a consumer product disposed therein. A fitment includes a body having a lower surface, an upper surface, a front surface, and a back surface. A slot extends from the lower surface of the body toward the upper surface of the body. A recess is formed in the front surface of the body and extends to the slot. The sachet is configured to be inserted at least partially into the slot.

Optionally, the sachet is configured to be torn by a user to provide an opening in the sachet, and the fitment is configured to seal the opening in the sachet when the sachet is inserted in the slot and the first portion of the body is aligned with the opening in the sachet. Optionally, the fitment is configured to allow the consumer product to flow through the opening in the sachet when the sachet is inserted in the slot and the second portion of the body is aligned with the opening in the sachet. Optionally, the fitment is adhered to the front panel or the back panel of the sachet prior to the sachet being inserted into the slot.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
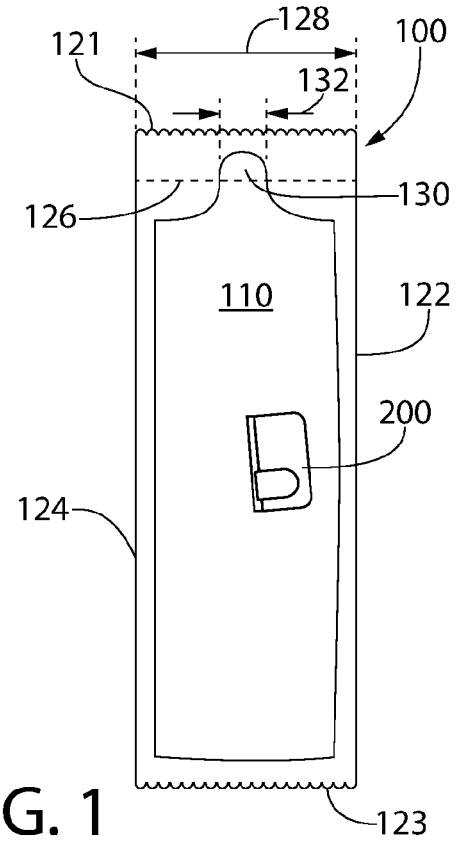
FIG. 1 depicts a front view of a sachet having a fitment ("first fitment") coupled to a front panel thereof, according to an embodiment.

FIG. 1 depicts a front view of a sachet 100 having a fitment ("first fitment") 200 coupled to a front panel 110 thereof, according to an embodiment. The sachet 100 may include a front panel 110 and a back panel (not shown). The front panel 110 and the back panel may each have a thickness from about 40 μm to about 400 μm or from about 110 μm to about 120 The front panel 110 and the back panel may be made from, for example, a laminate film. The laminate film may include linear low-density polyethylene ("LLDPE"), an adhesive, a barrier, polyethylene terephthalate ("PET"), or a combination thereof. The adhesive may be or include an ethylene acrylic acid ("EAA") natural copolymer. The barrier may be or include aluminum foil, metalized PET, silicon dioxide coated PET, ethylene vinyl alcohol ("EVOH"), or a combination thereof.

The front panel 110 and/or the back panel may include a label. The label may have a thickness from about 15 μm to about 100 μm or from about 25 μm to about 30 μm. The label may be made from a backer material, a release liner, an adhesive, a polymer film, or a combination thereof. The backer material may be clear, polyester, or paper. The polymer may be bi-axially oriented polypropylene or amorphous/oriented polyester.

The front panel 110 and the back panel may be coupled together around the edges 121-124, such that the sachet 100 defines an interior volume. A consumer product may be disposed within the interior volume. The consumer product may be or include a consumer product, such as toothpaste, mouthwash, shampoo, conditioner, body wash, lotion, house cleaning products, or the like; or a food product, such as ketchup, mustard, mayonnaise, or the like; or some other liquid or flowable product. As shown in FIG. 1, the interior volume may be shaped by the coupling of the front and back panel 110 to form a nozzle area for an opening 130 near one edge 121 of the sachet 100. In other embodiments (not shown), there may be two nozzle areas of the interior volume: one near the edge 121 and another near the edge 123.

To open the sachet 100, a user may tear a portion of the front panel 110 and/or the back panel across the neck-like area to provide the opening 130. As shown, the user may tear a portion of the front panel 110 and the back panel along the line 126. In embodiments such as this, the opening 130 may be or include the narrow portion of the nozzle area. As such, the opening 130 may have a length 132 that is less than the length 128 of the tear and of the edge 121. The length 132 of the opening 130 may be from about 1 mm to about 5 mm or about 2 mm to about 4 mm. In another embodiment, that may or may not include a nozzle area of the interior volume, the user may tear a portion of the front panel 110 and the back panel along one of the corners to form an opening. In yet another embodiment, the user may punch an opening in the front panel 110 or the back panel, but not both (see FIG. 10).

The first fitment 200 may initially be coupled to the front panel 110 or the back panel. As shown, the first fitment 200 may initially be coupled to the label on the front panel 110 using an adhesive. The user may remove the first fitment 200 from its original position by pulling on the fitment 200 with a predetermined force determined by the adhesive used, causing the first fitment 200 to release from the sachet 100 without harming the integrity of the sachet 100.

Figure 2:
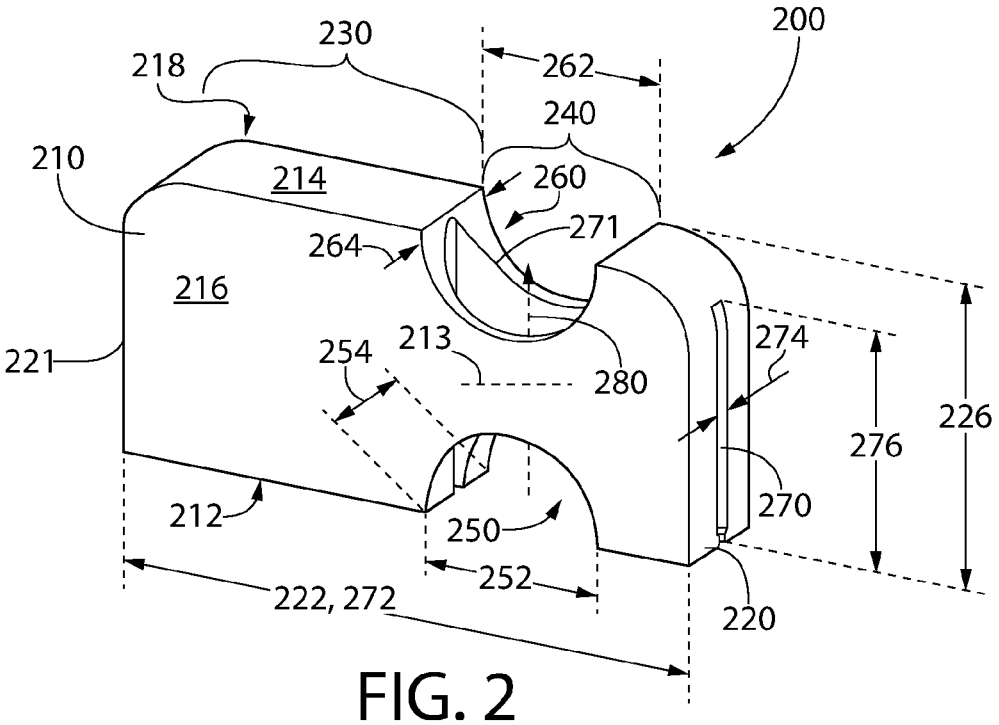
FIG. 2 depicts a perspective view of the first fitment, according to an embodiment.

FIG. 2 depicts a perspective view of the first fitment 200, according to an embodiment. The first fitment 200 may include a body 210 having a first portion 230 and a second portion 240 that are integral with one another and laterally-adjacent to one another. A slot 270 may be defined at least partially within the body 210 (e.g., within the first and second portions 230, 240). The slot 270 may extend from a lower surface 212 of the body 210 toward an upper surface 214 of the body 210. A length 272 of the slot 270 may be equal to a length 222 of the body 210. A width 274 of the slot 270 may be from about 0.25 mm to about 1 mm or from about 0.4 mm to about 0.7 mm. A height 276 of the slot 270 may be from about 50% to about 99% or about 75% to about 95% of a height 226 of the body 210.

In the first portion 230 of the body 210, the upper surface 214 of the body 210 may cap the slot 270 preventing any fluid communication therethrough in the direction from the lower surface 212 toward the upper surface 214. However, in the second portion 240 of the body 210, at least a portion of the upper surface 214 of the body 210 may be removed or omitted or notched such that a flow path 280 may extend through the body 210 in the direction from the lower surface 212 toward the upper surface 214. In other words, the slot 270 may extend into the second recess 260, which form an opening 271 in the upper surface 214 in the second portion 240 of the body 210, and the flow path 280 may extend through the slot 270 and the opening 271.

In the second portion 240 of the body 210, the width 274 of the slot 270 may vary. As shown, the width 274 of the slot 270 may vary in the first recess 250, the second recess 260, or both recesses 250, 260. The width 274 of the slot 270 may increase moving toward a midpoint 213 between the lower surface 212 and the upper surface 214. The width 274 of the slot 270 in the second portion 240 of the body 210 may be from about 2 mm to about 3.5 mm (e.g., 2.75 mm) at the widest point.

One or more recesses (two are shown: 250, 260) may be formed in the second portion 240 of the body 210. The first recess 250 may be formed in the lower surface 212 of the body 210 and extend toward the upper surface 214 of the body 210. As shown, in some embodiments, the first recess 250 may be wide enough that it extends laterally through the body 210 from a front surface 216 to a back surface 218. However, in other embodiments, the width 254 of the first recess 250 may be less than the width of the body 210. As shown, the first recess 250 may be round (e.g., semi-circular) with the length 252 of the first recess 250 decreasing moving toward the upper surface 214. The length 252 of the first recess 250 may be from about 5 mm to about 8 mm (e.g., about 6.35 mm) at the longest point. However, as will be appreciated, the first recess 250 may have other shapes and sizes (e.g., an oval, a rectangle, etc.).

The second recess 260 may be aligned with the first recess 250. The second recess 260 may be formed in the upper surface 214 of the body 210 and extend toward the lower surface 212 of the body 210. The portion of the upper surface 214 that defines the second recess 260 may also define the opening 271. As shown, in some embodiments, the second recess 260 may be wide enough that it extends laterally through the body 210 from the front surface 216 to the back surface 218. However, in other embodiments, the width 264 of the second recess 260 may be less than the width of the body 210. As shown, the second recess 260 may be round (e.g., semi-circular) with the length 262 of the second recess 260 decreasing moving toward the lower surface 212. The length 262 of the second recess 260 may be from about 5 mm to about 8 mm (e.g., about 6.35 mm) at the longest point. However, as will be appreciated, the second recess 260 may have other shapes and sizes (e.g., an oval, a rectangle, etc.).

Figure 3:
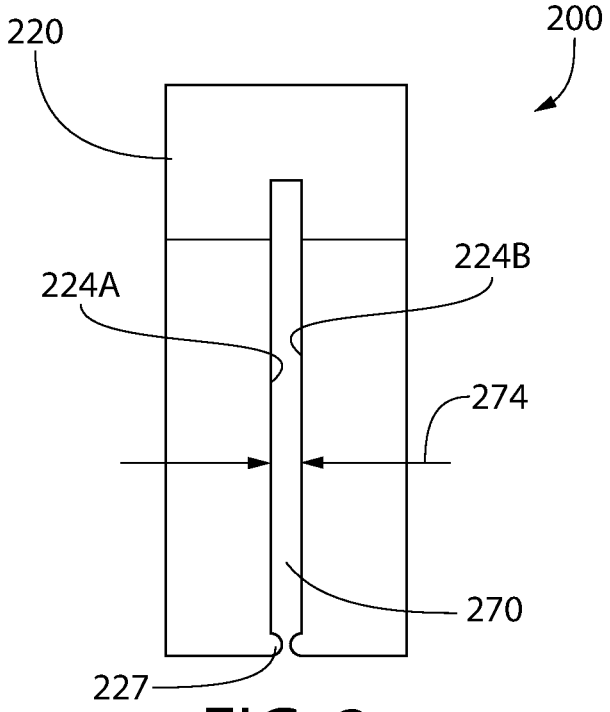
FIG. 3 depicts a view of a first side surface of the first fitment, according to an embodiment.

FIG. 3 depicts a view of a first side surface 220 of the first fitment 200, according to an embodiment. The slot 270 may be defined by opposing inner surfaces 224A, 224B of the body 210. The inner surfaces 224A, 224B of the body 210 defining the slot 270 may include one or more protrusions (two are shown: 227A, 227B) extending inwardly therefrom. As shown, the protrusions 227A, 227B may be positioned proximate to the lower surface 212 of the body 210 and extend inwardly across the slot 270 toward one another. The protrusions 227A, 227B may reduce the width 274 of the portion of the slot 270 between the protrusions 227A, 227B. The width 274 of the slot 270 at a first location between the protrusions 227A, 227B may be from about 10% to about 80% or from about 20% to about 50% of the width 274 of the slot 270 at a second location that is not between the protrusions 227A, 227B.

Figure 4:
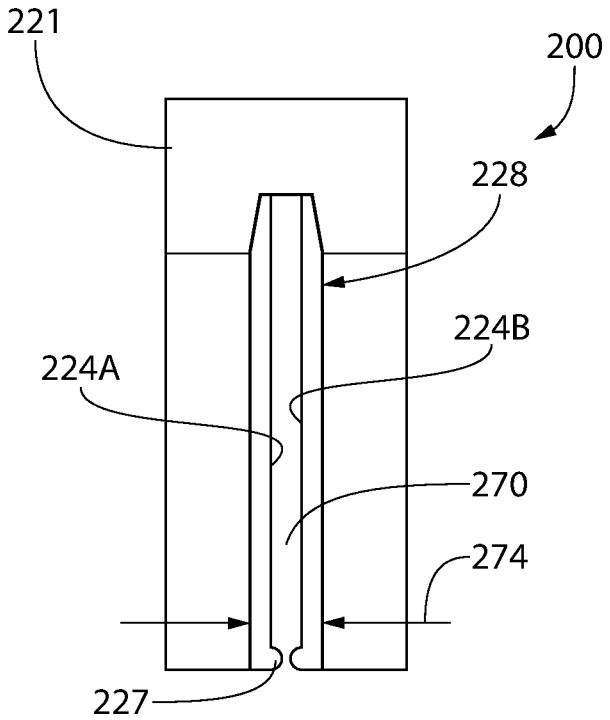
FIG. 4 depicts a view of a second side surface of the first fitment, according to an embodiment.
Figure 5:
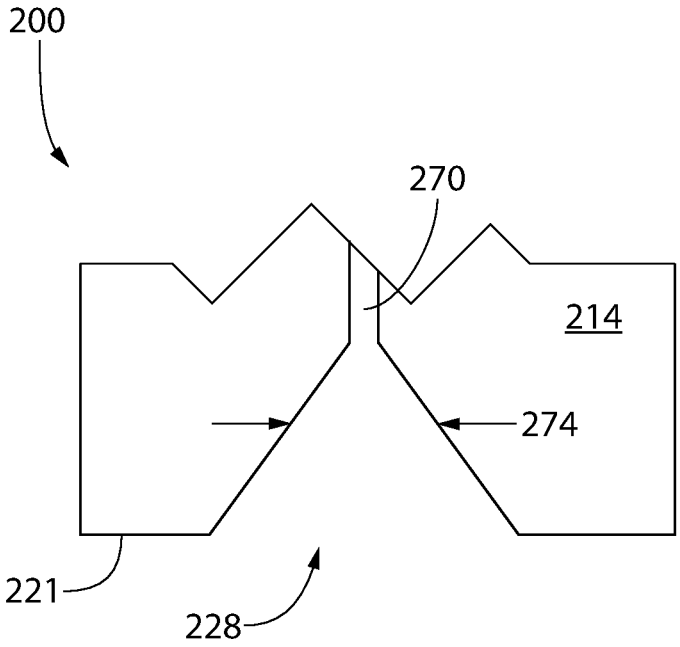
FIG. 5 depicts a top view of the upper surface of the first fitment proximate to the second side surface, according to an embodiment.

FIG. 4 depicts a view of a second side surface 221 of the first fitment 200, and FIG. 5 depicts a top view of the upper surface 214 of the first fitment 200 proximate to the second side surface 221, according to an embodiment. The slot 270 may include a tapering portion 228 proximate to the second side surface 221 of the body 210. More particularly, the width 274 of the slot 270 may taper down moving from the second side surface 221 of the body 210 toward the first side surface 220 of the body 210. The surfaces defining the tapering portion 228 may be oriented at an angle with respect to one another from about 20 degrees to about 60 degrees or from about 30 degrees to about 45 degrees. The tapering portion 228 may occur over 20% or less of the length 222 of the body 210. As discussed in greater detail below, the tapering portion 228 may facilitate the insertion of the sachet 100 into the slot 270 of the first fitment 200. Although the tapering portion 228 is shown formed in or near the second side surface 221, in other embodiments, the tapering portion 228 may be formed in or near the first side surface 220.

Figure 6:
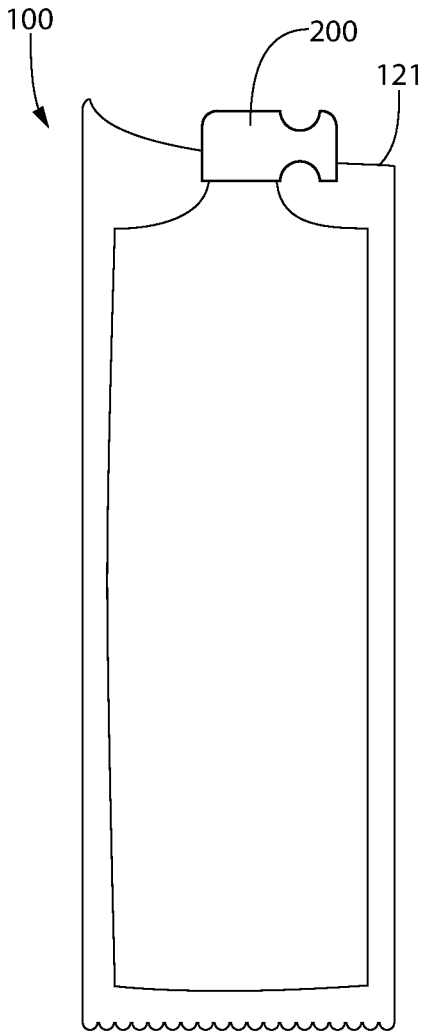
FIG. 6 depicts a front view of the sachet with the first fitment coupled to an edge thereof and in a first position that prevents the product inside the sachet from flowing out through an opening in the sachet, according to an embodiment.

FIG. 6 depicts a front view of the sachet 100 with the first fitment 200 coupled to an edge (e.g., a top edge 121) thereof after the original top edge 121 (shown in FIG. 1) has been torn away or otherwise removed. Here, the first fitment 200 is shown in a first position that prevents the product inside the sachet 100 from flowing out through the opening 130 (not shown in FIG. 6) in the sachet 100, according to an embodiment. In one illustrative use of the sachet 100, the user may pull the first fitment 200 to cause the first fitment 200 to separate from the front panel 110 of the sachet 100. The user may tear a portion of the front panel 110 and/or the back panel of the sachet 100 to create the opening 130. The user may then squeeze the sachet 100 to cause a portion of the product 190 to flow out through the opening 130. Alternatively, the user may leave the first fitment 200 attached to the front panel 110 of the sachet 100 (as shown in FIG. 1) until after the product 190 is dispensed, and then detach the first fitment 200 from the front panel 110.

After dispensing, the user may insert the top edge 121 of the sachet 100 into the slot 270 of the first fitment 200. More particularly, the user may insert the top edge 121 of the sachet 100 into the slot 270 through the tapering portion 228 to facilitate insertion. Once the sachet 100 is received in the slot 270, the user may move (e.g., slide) the first fitment 200 back and forth along the top edge 121 like a zipper. The top edge 121 may remain within the slot 270 as the first fitment 200 is moved. When the user desires to seal the sachet 100, the user may move the first fitment 200 to a first position with respect to the sachet 100, as shown in FIG. 6, where the first portion 230 of the first fitment 200 is aligned with the opening 130 in the sachet 100. When in the first position, the upper surface 214 of the first fitment 200 may serve as a cap that seals the opening 130 (not shown in FIG. 6).

Figure 7:
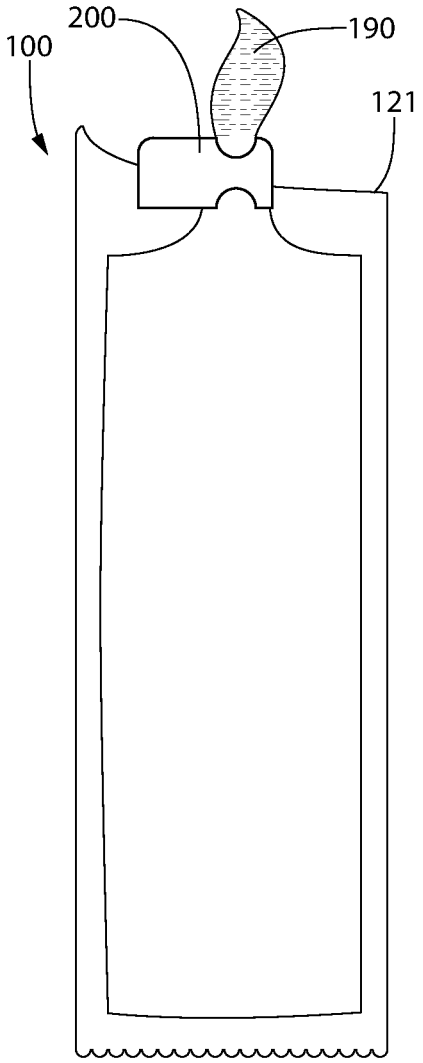
FIG. 7 depicts a front view of the sachet with the first fitment coupled to the edge and in a second position that allows the product inside the sachet to flow out through the opening in the sachet, according to an embodiment.

FIG. 7 depicts a front view of the sachet 100 with the first fitment 200 coupled to the top edge 121 and in a second position that allows the product 190 inside the sachet 100 to flow out through the opening 130 (not shown in FIG. 7) in the sachet 100, according to an embodiment. When the user once again desires to use the product 190, the user may move the first fitment 200 to the second position with respect to the sachet 100 where the second portion 240 of the first fitment 200 is aligned with the opening 130 in the sachet 100. The user may then squeeze the sachet 100, causing the product 190 to flow through the flow path 280 in the second portion 240 of the first fitment 200.

Figure 8:
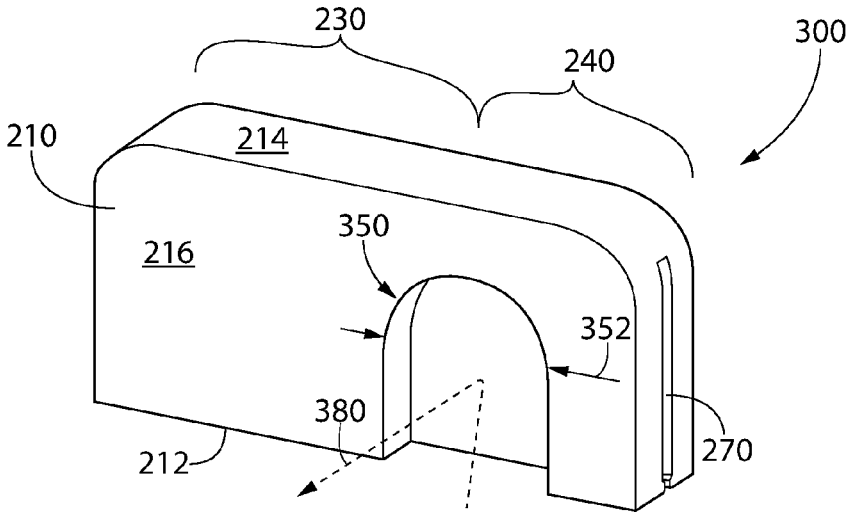
FIG. 8 depicts a perspective view of another fitment ("second fitment"), according to an embodiment.

FIG. 8 depicts a perspective view of another fitment ("second fitment") 300, according to an embodiment. The first portion 230 of the body 210 of the second fitment 300 may be similar to the first portion 230 of the body 210 of the first fitment 200, and similar reference numbers are used.

In the second portion 240 of the body 210, the upper surface 214 of the body 210 may cap the slot 270 preventing fluid communication therethrough in the direction from the lower surface 212 to the upper surface 214. One or more recesses (one is shown: 350) may be formed in the second portion 240 of the body 210. The recess 350 may be formed in the lower surface 212 of the body 210 and extend toward the upper surface 214 of the body 210. The recess 350 may also be formed in the front surface 216 of the body 210 and extend toward the back surface 218 of the body 210 (e.g., to the wall of the slot 270). Thus, the recess 350 may provide a flow path 380 from the slot 270 out through the front surface 216 of the second fitment 300.

The recess 350 may be in the shape of a half oval with the length 352 of the recess 350 initially remaining constant and then decreasing moving toward the upper surface 214. The length 352 of the recess 350 may be from about 5 mm to about 8 mm (e.g., about 6.35 mm) at the longest point. However, as will be appreciated, the recess 350 may have other shapes and sizes (e.g., a semi-circle, a rectangle, a triangle, etc.).

Figure 9:
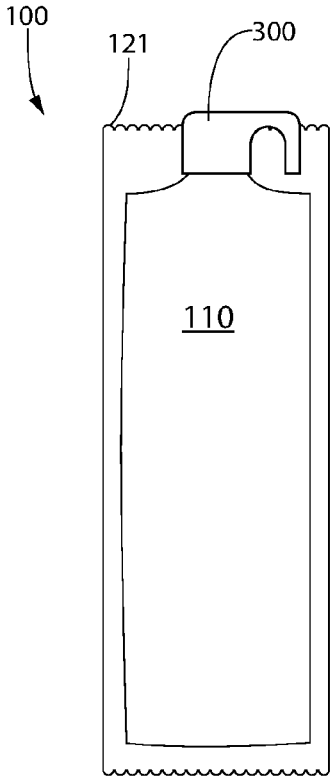
FIG. 9 depicts a front view of a sachet with the second fitment coupled to an edge thereof and in a first position that prevents the product inside the sachet from flowing out through an opening in the sachet, according to an embodiment.
Figure 10:
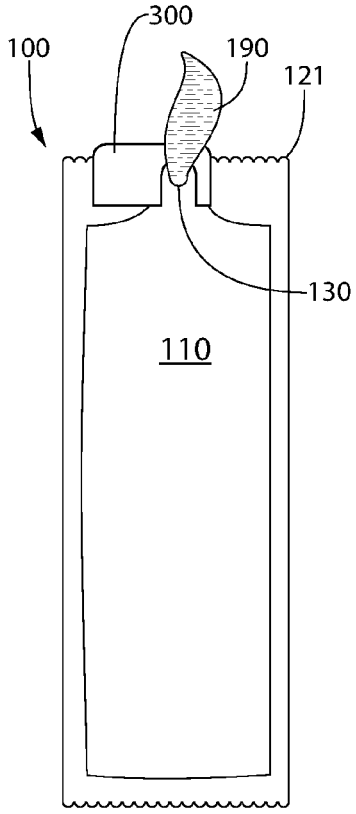
FIG. 10 depicts a front view of the sachet with the second fitment coupled to the edge and in a second position that allows the product inside the sachet to flow out through the opening in the sachet, according to an embodiment.

FIG. 9 depicts a front view of the sachet 100 with the second fitment 300 coupled to an edge (e.g., a top edge 121) thereof after an opening has been punched in the front panel 110 of the sachet 100 (e.g., proximate to the top edge 121). Here, the first fitment 200 is shown in a first position that prevents the product 190 inside the sachet 100 from flowing out through the opening 130 (not shown in FIG. 9) in the sachet 100, according to an embodiment. In one illustrative use of the sachet 100, the user may punch an opening 130 (as shown in FIG. 10) in the front panel 110 or the back panel of the sachet 100. The opening 130 may be proximate to (e.g., within 5 mm from) the top edge 121 of the sachet 100. The user may then squeeze the sachet 100 to cause a portion of the product 190 to flow out through the opening 130. The user may then pull the second fitment 300 to cause the second fitment 300 to separate from the front panel 110 of the sachet 100. The user may then insert the top edge 121 of the sachet 100 into the slot 270 of the second fitment 300. More particularly, the user may insert the top edge 121 of the sachet 100 into the slot 270 through the tapering portion 228 to facilitate insertion. Once the sachet 100 is received in the slot 270, the user may move (e.g., slide) the second fitment 300 back and forth along the top edge 121 like a zipper. The top edge 121 may remain within the slot 270 as the second fitment 300 is moved. When the user desires to seal the sachet 100, the user may move the second fitment 300 to a first position with respect to the sachet 100 (as shown in FIG. 9) where the first portion 230 of the second fitment 300 is aligned with the opening 130 in the sachet 100. When in the first position, the first portion 230 of the second fitment 300 may seal the opening 130.

FIG. 10 depicts a front view of the sachet 100 with the second fitment 300 coupled to the top edge 121 and in a second position that allows the product 190 inside the sachet 100 to flow out through the opening 130 in the sachet 100, according to an embodiment. When the user once again desires to use the product 190, the user may move the second fitment 300 to the second position with respect to the sachet 100 where the second portion 240 of the second fitment 300 is aligned with the opening 130 in the sachet 100. The user may then squeeze the sachet 100, causing the product 190 to flow through the flow path 380 in the second portion 240 of the second fitment 300.

Figure 11:
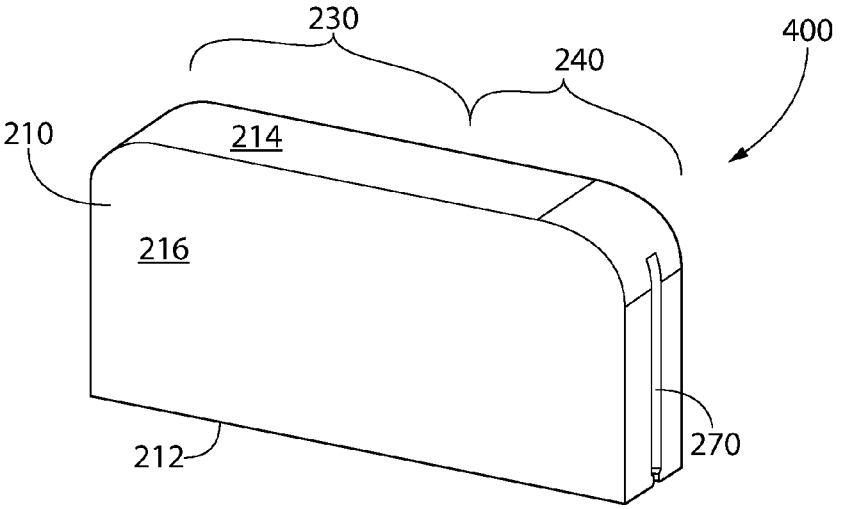
FIG. 11 depicts a perspective view of another fitment ("third fitment"), according to an embodiment.

FIG. 11 depicts a perspective view of another fitment ("third fitment") 400, according to an embodiment. The first portion 230 of the body 210 of the third fitment 400 may be similar to the first portion 230 of the body 210 of the first and second fitments 200, 300, and similar reference numbers are used. The second portion 240 of the body 210 of the third fitment 400 may be similar to the first portion 230 of the body 210 of the third fitment 400. Thus, neither the first portion 230 nor the second portion 240 may provide a flow path through which the fluid may flow through the body 210.

Figure 12:
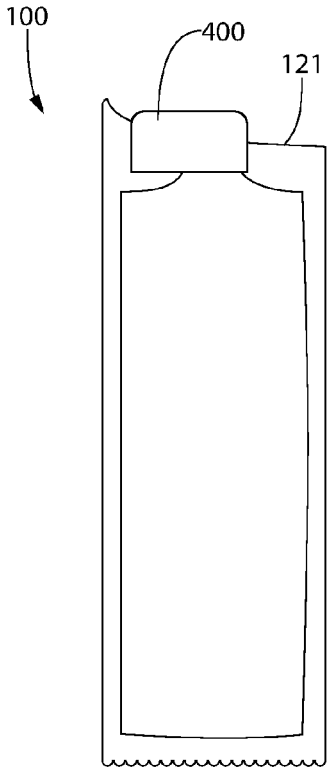
FIG. 12 depicts a front view of the sachet with the third fitment coupled to an edge thereof and in a first position that prevents the product inside the sachet from flowing out through an opening in the sachet, according to an embodiment.

FIG. 12 depicts a front view of the sachet 100 with the third fitment 400 coupled to an edge (e.g., the top edge) 121 thereof after the original top edge 121 (shown in FIG. 1) has been torn away or otherwise removed. Here, the third fitment 400 is shown in a first position that prevents the product inside the sachet 100 from flowing out through the opening 130 (not shown in FIG. 12) in the sachet 100, according to an embodiment. In one illustrative use of the sachet 100, the user may tear a portion of the front panel 110 and/or the back panel of the sachet 100 to create the opening 130 (as in FIGS. 6 and 7) or punch an opening 130 in the front panel 110 or the back panel of the sachet 100 (as in FIGS. 9 and 10). The user may then squeeze the sachet 100 to cause a portion of the product 190 to flow out through the opening 130. The user may then pull the third fitment 400 to cause the third fitment 400 to separate from the front panel 110 of the sachet 100. The user may then insert the top edge 121 of the sachet 100 into the slot 270 of the third fitment 400. More particularly, the user may insert the top edge 121 of the sachet 100 into the slot 270 through the tapering portion 228 to facilitate insertion. Once the sachet 100 is received in the slot 270, the user may move (e.g., slide) the third fitment 400 back and forth along the top edge 121. The top edge 121 may remain within the slot 270 as the third fitment 400 is moved. When the user desires to seal the sachet 100, the user may move the third fitment 400 to a first position with respect to the sachet 100 where the third fitment 400 (e.g., the first portion 230, the second portion 240, or a combination thereof) is aligned with the opening 130 in the sachet 100. When in the first position, the third fitment 400 may seal the opening 130.

Figure 13:
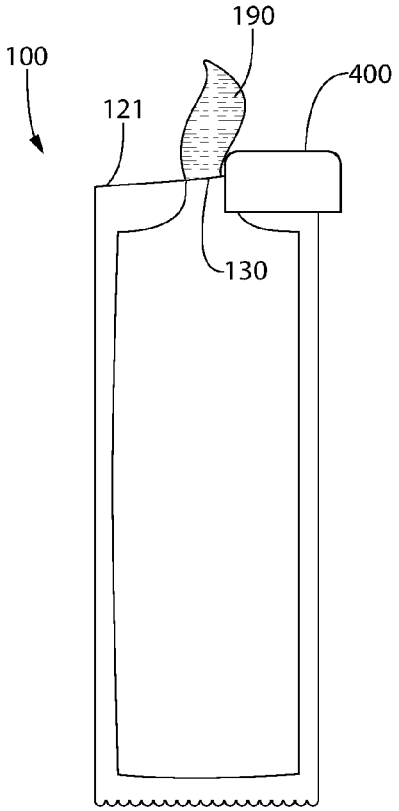
FIG. 13 depicts a front view of the sachet with the third fitment coupled to the edge and in a second position that allows the product inside the sachet to flow out through the opening in the sachet, according to an embodiment.

FIG. 13 depicts a front view of the sachet 100 with the third fitment 400 coupled to the top edge 121 and in a second position that allows the product 190 inside the sachet 100 to flow out through the opening 130 in the sachet 100, according to an embodiment. When the user once again desires to use the product 190, the user may move the third fitment 400 to a second position with respect to the sachet 100 where the third fitment 400 is laterally-offset from (i.e., no portion of the third fitment 400 is aligned with) the opening 130 in the sachet 100. The user may then squeeze the sachet 100, causing the product 190 to flow through the opening 130 in the sachet 100.

Figure 14:
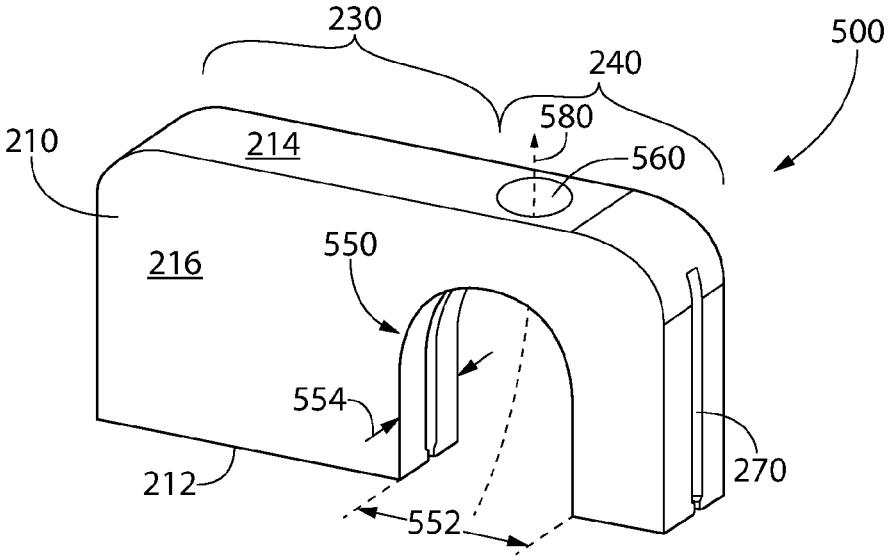
FIG. 14 depicts a perspective view of another fitment ("fourth fitment"), according to an embodiment.

FIG. 14 depicts a perspective view of another fitment ("fourth fitment") 500, according to an embodiment. The first portion 230 of the body 210 of the fourth fitment 500 may be similar to the first portion 230 of the body 210 of the first, second, and third fitments 200, 300, 400, and similar reference numbers are used.

The second portion 240 of the body 210 may have a recess 550 formed therein. The recess 550 may be formed in the lower surface 212 of the body 210 and extend toward the upper surface 214 of the body 210. As shown, in some embodiments, the recess 550 may be wide enough that it extends laterally through the body 210 from the front surface 216 to the back surface 218. However, in other embodiments, the width 554 of the recess 550 may be less than the width of the body 210. As shown, the recess 550 may be at least partially oval with the length 552 of the recess 550 initially remaining constant and then decreasing moving toward the upper surface 214. The length 552 of the recess 550 may be from about 5 mm to about 8 mm (e.g., about 6.35 mm) at the longest point. However, as will be appreciated, the recess 550 may have other shapes and sizes (e.g., a semi-circle, a rectangle, etc.).

The second portion 240 of the body 210 may also have a bore 560, which forms an opening in the upper surface 214. The bore 560 may extend from the upper surface 214 to the slot 270 and/or the recess 550. As such, a flow path 580 may extend through the recess 550 and/or the slot 270, and through the bore 560.

Figure 15:
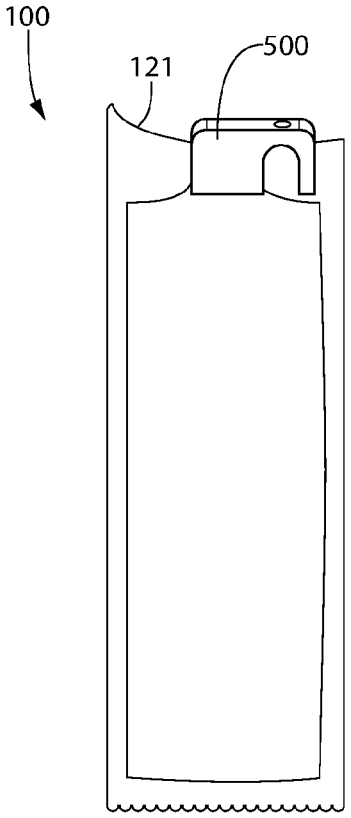
FIG. 15 depicts a front view of the sachet with the fourth fitment coupled to an edge thereof and in a first position that prevents the product inside the sachet from flowing out through an opening in the sachet, according to an embodiment.

FIG. 15 depicts a front view of the sachet 100 with the fourth fitment 500 coupled to an edge (e.g., the top edge) 121 thereof after the original top edge 121 (shown in FIG. 1) has been torn away or otherwise removed. Here, the fourth fitment 500 is shown in a first position that prevents the product inside the sachet 100 from flowing out through the opening 130 (not shown in FIG. 15) in the sachet 100, according to an embodiment. In one illustrative use of the sachet 100, the user may tear a portion of the front panel 110 and/or the back panel of the sachet 100 to create the opening 130. The user may then squeeze the sachet 100 to cause a portion of the product 190 to flow out through the opening 130. The user may then pull the fourth fitment 500 to cause the fourth fitment 500 to separate from the front panel 110 of the sachet 100. The user may then insert the top edge 121 of the sachet 100 into the slot 270 of the fourth fitment 500. More particularly, the user may insert the top edge 121 of the sachet 100 into the slot 270 through the tapering portion 228 to facilitate insertion. Once the sachet 100 is received in the slot 270, the user may move (e.g., slide) the fourth fitment 500 back and forth along the top edge 121. The top edge 121 may remain within the slot 270 as the fourth fitment 500 is moved. When the user desires to seal the sachet 100, the user may move the fourth fitment 500 to a first position with respect to the sachet 100 where the first portion 230 of the fourth fitment 500 is aligned with the opening 130 in the sachet 100, as shown in FIG. 15. When in the first position, the upper surface 214 of the fourth fitment 500 may serve as a cap that seals the opening 130.

Figure 16:
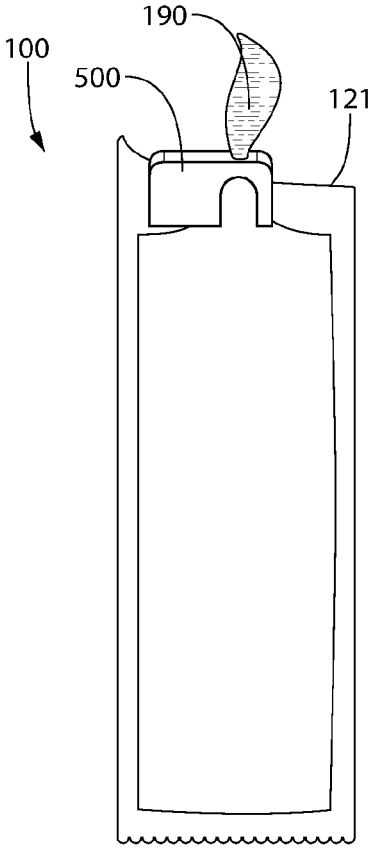
FIG. 16 depicts a front view of the sachet with the fourth fitment coupled to the edge and in a second position that allows the product inside the sachet to flow out through the opening in the sachet, according to an embodiment.

FIG. 16 depicts a front view of the sachet 100 with the fourth fitment 500 coupled to the edge 121 and in a second position that allows the product 190 inside the sachet 100 to flow out through the opening 130 (not shown in FIG. 16) in the sachet 100, according to an embodiment. When the user once again desires to use the product 190, the user may move the fourth fitment 500 to a second position with respect to the sachet 100 where the second portion 240 of the fourth fitment 500 is aligned with the opening 130 in the sachet 100. The user may then squeeze the sachet 100, causing the product 190 to flow through the flow path 580 in the second portion 240 of the fourth fitment 500.

What is claimed is:

1. A packaging system, comprising:

a sachet comprising a front panel and a back panel that are coupled to one another, wherein the front panel and the back panel define an interior volume having a consumer product disposed therein; and a fitment comprising a body having a slot that extends from a lower surface of the body toward an upper surface of the body, wherein the upper surface caps the slot in a first portion of the body such that fluid flow is prevented through the first portion of the body in a direction from the lower surface toward the upper surface, wherein the slot connects to an opening in the upper surface in a second portion of the body, wherein a flow path exists through the slot and the opening in the second portion of the body in the direction from the lower surface toward the upper surface, wherein the fitment is adhered to the front panel or the back panel of the sachet, and wherein the sachet is configured to be inserted at least partially into the slot of the fitment after being removed from the front panel or the back panel.

2. The packaging system of claim 1, wherein the sachet is configured to be torn by a user to provide an opening in the sachet, and wherein the fitment is configured to seal the opening in the sachet when the sachet is inserted in the slot and the first portion of the body is aligned with the opening in the sachet.

3. The packaging system of claim 2, wherein the fitment is configured to allow the consumer product to flow through the opening in the sachet when the sachet is inserted in the slot and the second portion of the body is aligned with the opening in the sachet.

4. The packaging system of claim 1, wherein a first recess is defined in the lower surface of the second portion of the body, wherein a second recess is defined in the upper surface of the second portion of the body, and wherein the first and second recesses are aligned with one another.

* * * * *